US005313145A

United States Patent [19]

Francis, Jr. et al.

[11] Patent Number: 5,313,145

[45] Date of Patent: May 17, 1994

[54] POWER SUPPLY FOR A GAS DISCHARGE DEVICE

[76] Inventors: Ralph M. Francis, Jr., 1505 Crabapple Dr., Racine, Wis. 53405; Michael Garjian, 417 Turnpike St., Stoughton, Mass. 02072

[21] Appl. No.: 938,902

[22] Filed: Aug. 31, 1992

[51] Int. Cl.[5] ..... G05F 1/00

[52] U.S. Cl. ..... 315/307; 315/127; 315/225; 315/224

[58] Field of Search ..... 315/127, 307, 225, 291, 315/D4, 224

[56] References Cited

U.S. PATENT DOCUMENTS

| | | | |
|---|---|---|---|
| 3,890,537 | 6/1975 | Park et al. | 315/247 X |
| 3,913,002 | 10/1975 | Steigerwald et al. | 315/283 X |
| 4,321,507 | 3/1982 | Bosnak | 315/224 X |
| 4,415,959 | 11/1983 | Vinciarelli | 363/21 |
| 4,613,934 | 9/1986 | Pacholok | 363/131 |
| 4,698,741 | 10/1987 | Pacholok | 363/131 |
| 4,870,327 | 9/1989 | Jorgensen | 315/307 |
| 4,870,554 | 9/1989 | Smith | 363/20 |
| 4,882,663 | 11/1989 | Nilssen | 363/19 |
| 4,904,904 | 2/1990 | Zarate | 315/219 |
| 4,914,356 | 4/1990 | Cockram | 315/246 X |
| 4,933,829 | 6/1990 | White | 363/95 |
| 4,945,466 | 7/1990 | Borland | 363/97 |
| 5,041,960 | 8/1991 | Tseruel | 363/131 |
| 5,075,598 | 12/1991 | Doss | 315/224 |

*Primary Examiner*—Robert J. Pascal
*Assistant Examiner*—Reginald Ratliff
*Attorney, Agent, or Firm*—Quarles & Brady

[57] ABSTRACT

A transformer has a primary winding connected in series with a direct current source, a solid state switch and a current sensing resistor. A reactive element is coupled to the primary winding to form a resonant circuit. A high voltage for exciting a gaseous discharge device is produced across a first secondary winding of the transformer. A second resistor couples a terminal of the direct current source to one plate of a storage capacitor that has another plate connected to a second terminal of the direct current source. The one plate of the storage capacitor also is connected to a second secondary winding of the transformer. The control circuitry for the power supply is biased by voltage stored across the capacitor. A circuit branch applies a bias potential to a control electrode of the solid state switch to render the switch conductive, and has a delay element which prevents the solid state switch from becoming conductive until a sufficient voltage level exists across the storage capacitor to bias the control circuitry into operation. A switch circuit a turns off the solid state switch either when the voltage across the first resistor exceeds a given level or when the voltage across the second secondary winding exceeds a predefined magnitude.

13 Claims, 2 Drawing Sheets

AC SUPPLY
DIODE BRIDGE
+
−
C1
12
10
22
D1
C3
14
19
18
20
16
21
R3
C4
R1
D2
26
R4
Q1
R2
R5
Q2
D3
Q3
C2
24
R6
D4
R7
Q4
R8
C7
C6
C5
R9
R11
R10

POWER SUPPLY FOR A GAS DISCHARGE DEVICE

BACKGROUND OF THE INVENTION

The present invention relates to gaseous discharge devices, such as those used to create luminous displays or signs; and particularly to the power supply for exciting a gaseous discharge device.

Luminous displays are constructed by infusing a gas, such as neon or argon, into a hermetically sealed transparent structure, such as a tube or a sandwich of plates. When a high alternating excitation voltage is directly or indirectly applied to the gas, the gas ionizes causing it to glow.

The conventional power supply for applying the excitation voltage to the gaseous discharge device comprised merely a high voltage transformer which stepped the line voltage (120 volts at 60 Hertz or 240 volts at 50 Hertz) up to the high excitation voltage. Although this power supply is simple, it is relatively bulky and heavy. When the transformer is integrated with a gaseous discharge device, packaging must be provided to insure that the heavy transformer does not come into contact with the device during shipment to avoid damage. In addition, different transformers must be provided if the discharge device is to be supplied with 120 volts or 240 volts.

An alternative type of high voltage power supply is commonly referred to as a resonant converter. In this device, the primary winding of the transformer was connected to a resonant circuit which applied pulses of the rectified line voltage to the primary winding, as described in U.S. Pat. No. 4,613,934. Because of the resonant nature of the supply circuit, the peak voltage applied to the primary winding was several times the supply line voltage and the frequency of the primary voltage is several hundred times the supply line frequency. This enabled the number of windings of the primary to be reduced, and the transformer core made lighter. A transistor often was used to switch the current to the primary winding and care had to be taken that the transistor was switched off only when the resonating current went to zero else the transistor might fail.

Another drawback to gaseous discharge devices in general is the difficulty encountered when one wants to create flashing illumination. Very sophisticated power supply circuits are required to produce an intermittent excitation of the gaseous discharge device, since switching of a control transistor at random times during the excitation cycle can cause the transistor to fail.

SUMMARY OF THE INVENTION

A high voltage power supply includes a source of direct current having first and second output terminals across which transformer has a primary winding and a conduction path of a solid state switch connected in series. When a control electrode of the solid state switch is properly biased, the conduction path becomes conductive enabling current to flow from the source of direct current through the primary winding. A reactive element is coupled to the primary winding to form a resonant circuit.

Changes in the flow of current through the transformer induce a high output voltage in a first secondary winding. A second secondary winding of the transformer produces a voltage that is coupled to a control circuit. The control circuit applies a bias potential to the control electrode of the solid state switch so as to render the conduction path conductive. The control circuit removes the bias potential from the control electrode in response to the current flowing through the primary winding exceeding a predefined level. In the preferred embodiment, the control circuit also removes the bias potential from the control electrode in response to the voltage across the primary winding exceeding a predetermined magnitude.

An object of the present invention is to provide a resonant voltage converter in which the current flow to the primary winding of the transformer can be switched off in the middle of the resonant cycle when current is flowing through the transformer. The current flow is switched off in response to the magnitude of the current exceeding a threshold.

Another object is to provide a control circuit that switches the current flow and which is powered from a secondary winding of the transformer.

A further object of the present invention is to provide a mechanism by which the portion of the circuit that responds to the magnitude of the current becomes operational before current can be switched to the primary winding of the transformer.

Yet another object is to provide a voltage converter in which the current supplied varies inversely with fluctuations in the AC supply voltage, thereby maintaining the power output of the converter relatively constant for small variations in the input voltage. This characteristic of the converter is advantageous during a "brown-out," when the electric utility intentionally decreases the supply voltage.

DESCRIPTION OF THE PRESENT INVENTION

Figure 1:
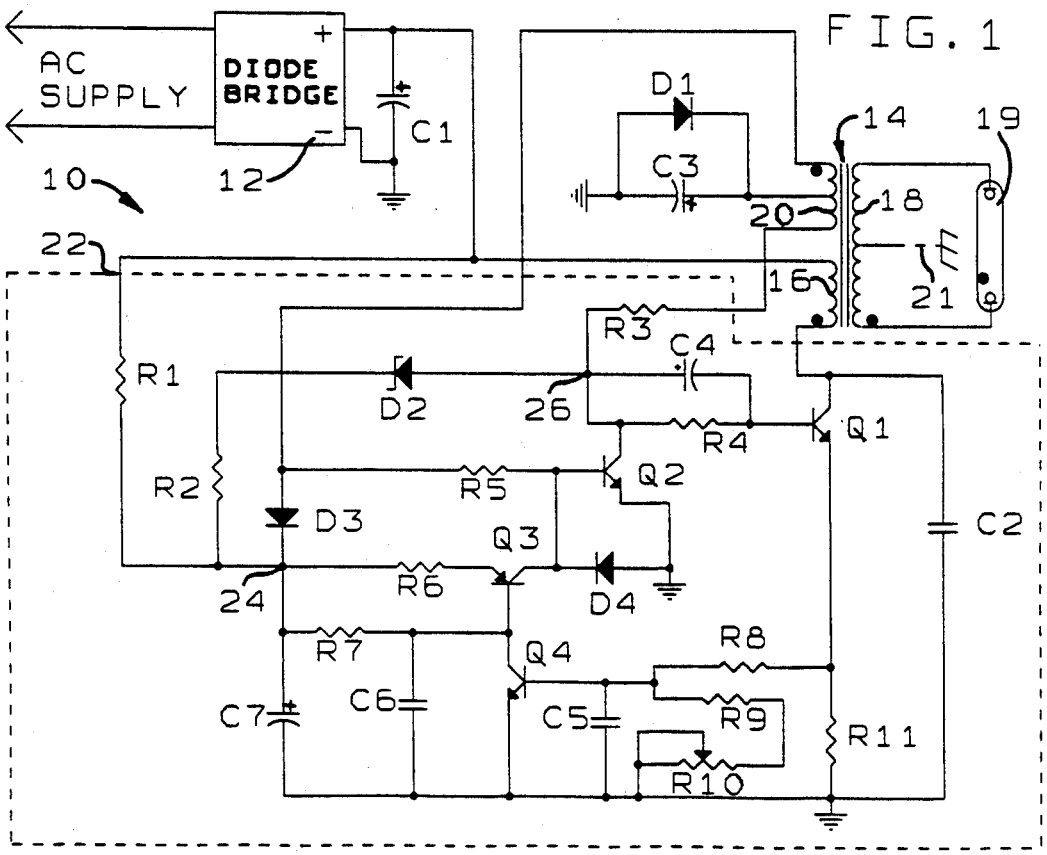
FIG. 1 is a schematic diagram of a power supply according to the present invention.

With initial reference to FIG. 1, a high voltage power supply 10 receives alternating electricity from a source that is connected to the input of a diode bridge, full-wave rectifier 12. The rectifier 12 produces a DC output voltage across a filter capacitor C1. The negative terminal of the bridge rectifier 12 is connected to the circuit ground and the positive terminal is connected to one end of a primary winding 16 of output transformer 14. The other end of the primary winding 16 is connected to ground through the collector-emitter conduction path of drive transistor Q1 which is in series with a current sensing resistor R11. When the drive transistor Q1 is turned on, DC current from the rectifier 12 flows through the primary winding 16. A capacitor C2 is connected between the collector of drive transistor Q1 and circuit ground, in parallel with transistor Q1 and resistor R11, to form a resonant circuit with the primary winding 16.

The output transformer 14 has two secondary windings. One secondary winding 18 produces the high output voltage and is connected to a gaseous discharge device 19. Secondary winding 18 may have a center tap 21 connected to earth ground. Another secondary winding 20 has an intermediate tap that is connected to ground by capacitor C3. A diode D1 is placed in parallel to capacitor C3 with the anode of the diode being connected to circuit ground. As will be described, this latter secondary winding 20 produces a feedback signal that in part governs the operation of a control circuit 22 which operates drive transistor Q1.

The control circuit 22 has a node 24 that is connected to the positive terminal of the diode bridge rectifier 12 by resistor R1. A relatively large capacitor C7 is connected between node 24 and circuit ground. As will be described, capacitor C7 is charged by voltage pulses appearing at node 24 and in turn supplies bias voltage to the components of the control circuit 22. The series connection of resistor R2 and Zener diode D2 couples node 24 to node 26, which in turn is connected by resistor R3 to one end of secondary winding 20. The other end of this secondary winding 20 is connected by diode D3 to node 24 of the control circuit. Node 26 is connected to the base of drive transistor Q1 by resistor R4 and capacitor C4, which are connected in parallel.

The node 28 between diode D3 and secondary winding 20 of the output transformer 14 is connected by resistor R5 to the base of transistor Q2 having its collector connected to node 26 and its emitter connected to circuit ground. The base of transistor Q2 also is coupled to ground by normally reversed biased diode D4, which prevents an extremely negative voltage from occurring at the transistor's base during collapse of a magnetic field in the transformer 14. Transistor Q3 has a collector attached to the base of transistor Q2 and an emitter coupled to node 24 by resistor R6. The base of transistor Q3 is connected to node 24 by resistor R7 and to circuit ground by the collector-emitter path of transistor Q4.

The base of transistor Q4 is controlled by the magnitude of the current flowing through the primary winding 16 of output transformer 14. This current flow produces a proportional voltage across sensing resistor R11, which voltage also appears across a voltage divider consisting of resistors R8, R9 and R10 connected in series. Resistor R10 is variable providing an adjustable threshold for the primary winding current at which transistor Q4 turns on. Resistor R9 may be a cadmium photo cell which alters the voltage divider with changes in the ambient light in which the gaseous discharge device is located. The junction between resistors R8 and R9 is connected to the base of transistor Q4 and to circuit ground by a filter capacitor C5. Another capacitor C6 is connected across the emitter and collector of transistor Q4.

When electricity from an AC supply is initially applied to the power supply rectifier 12, capacitors C1 and C7 begin charging. Capacitor C7 charges at a slower rate determined by the time constant defined by resistor R1. The time constant provided by R1 eliminates capacitors C1 and C7 from charging simultaneously. While capacitor C7 is initially charging, Zener diode D2 prevents drive transistor Q1 from turning on until the diode breakdown voltage is exceeded. This provides a delay which allows the voltage at node 24 produced across capacitor C7 to rise to a level at which the components of the control circuit 22 will be properly biased. The delay insures that the control circuit 22 will be operational before drive transistor Q1 becomes conductive and before current is applied to the primary winding 16 of the output transformer 14.

Capacitor C7 serves as a filter capacitor for the low supply voltage which powers the control circuit 22. During normal operation, the control circuit 22 is supplied with current induced in the secondary winding 20 and conveyed by diode D3 to node 24. In this phase of operation, negligible current flows from the diode bridge rectifier 12 through resistor R1 to node 24. Thus in this mode, the control circuit 22 is supplied by the self generated low voltage from secondary winding 20, eliminating large power losses which would otherwise occur in resistor R1 to reduce the voltage from rectifier 12 to a relatively low level for powering the control circuit 22.

Eventually, the Zener diode D2 breaks down providing a bias on the base of drive transistor Q1 which renders that transistor conductive and permits current to flow through the primary winding 16. Diode D1 and capacitor C3 block the bias voltage from flowing through secondary winding 20 at this time. The rapid rise in current through the primary winding 16 induces current in both of the secondary windings 18 and 20. As the current flowing through the primary winding 16 increases, the voltage across current sensing resistor R1 rises proportionally. When this voltage exceeds a threshold level set by the voltage divider, resistors R8–R10, transistor Q4 will turn on. When a cadmium photo cell is used as resistor R9, the threshold level varies with changes in the ambient light so that transistor Q4 turns on at higher primary current levels when the ambient light is brighter. Thus, the gaseous discharge device will glow brighter in a brightly lighted environment. Capacitor C5 acts as a filter smoothing rise time irregularities which occur in the voltage across the sensing resistor R11, thereby preventing the irregularities from affecting transistor Q4.

When transistor Q4 turns on, transistor Q3 becomes conductive producing a similar turn-on of transistor Q2. The time constant provided by resistor R7 and capacitor C6 insures that transistor Q3 will remain on for several microseconds. In the conductive state, transistor Q2 pulls the base of drive transistor Q1 to ground, turning off the latter transistor. Once the collector of Q2 is at ground potential the network of resistor R4 and capacitor C4 act to affect a very sharp cut turn off and to prevent failure of that transistor. This action terminates the flow of current through the primary winding 16 of output transformer 14, shutting down the application of current in mid-cycle. As the transformer's magnetic field collapses, current is induced in the secondary winding 20 which is applied through resistor R3 to the collector of transistor Q2 causing the voltage at the collector to go negative. This negative bias further expedites the shut down junction sweep of drive transistor Q1.

The current induced in secondary winding 20 as the transformer's field collapses produces a positive voltage at the anode of diode D3, recharging capacitor C7 and providing a positive supply voltage for the control circuit 22. This positive voltage at the anode of diode D3 also is applied by resistor R5 to the base of transistor Q2 further clamping that transistor in a conductive state while shutdown of the current through the primary winding 16 is occurring. Therefore, transistor Q2 continues to be biased conductive for a time after transistors Q3 and Q4 turn off.

When the current through the primary winding 16 drops essentially to zero, transistors Q3 and Q4 turn off. The voltage across secondary winding 20 also goes to zero soon thereafter, turning off transistor Q2 which allows the bias voltage at the base of drive transistor Q1 to rise. Eventually the bias voltage again turns on drive transistor Q1 repeating the cycle in which current pulses are applied through the primary winding 16.

In addition to the magnitude of current through the primary winding 16 controlling the conduction of drive transistor Q1, this transistor also is turned off when the voltage across the primary winding exceeds a given magnitude. As the primary voltage rises, a proportional voltage is induced across the secondary winding 20, which is coupled to the base of transistor Q2 by resistor R5. When this secondary voltage exceeds a predefined level, as determined by the value of resistor R5, transistor Q2 turns on. With transistor Q2 conductive, the base of drive transistor Q1 is pulled to ground cutting off the flow of current through the primary winding 16 until the secondary winding voltage drops below the predefined level.

Thus, the present power supply provides two mechanisms for producing a resonant flow of current through the output transformer 14, based on whether the primary winding voltage or current exceed given threshold levels. This enables the same power supply topology to be used with AC supplies of different voltages and different frequencies (e.g., 120 volts at 60 Hertz or 240 volts at 50 Hertz).

Power supply 10 also maintains the brightness of the gaseous discharge device 19 at a relatively constant level in spite of fluctuations of the AC supply voltage Vac. As the supply voltage to a conventional power supply fluctuates, a proportional fluctuation occurs in the current producing a variation in power corresponding to the square of the voltage fluctuation. The power variation produces a change in the brightness of the light generated by the gaseous discharge device.

In contrast, the present power supply 10 holds the power supplied to the gaseous discharge device 19 relatively constant in spite of fluctuations in the AC supply voltage Vac, thereby maintaining the brightness of the generated light uniform. The bias voltage for the control circuit is developed across capacitor C7 by the connection through diode D3 to secondary winding 20. By deriving the bias voltage from the transformer, the bias voltage changes as a function of how much power is being developed. Thus as the AC supply voltage Vac changes, the circuit produces an inverse proportional change in the current which maintains the power and the brightness relatively constant. This characteristic of the present power supply 10 is particularly advantageous during a "brown—out," when the electric utility intentionally decreases the line voltage. It will be understood, of course, that excessive variations in the supply line voltage Vac will produce a variation in the power and brightness.

Figure 2:
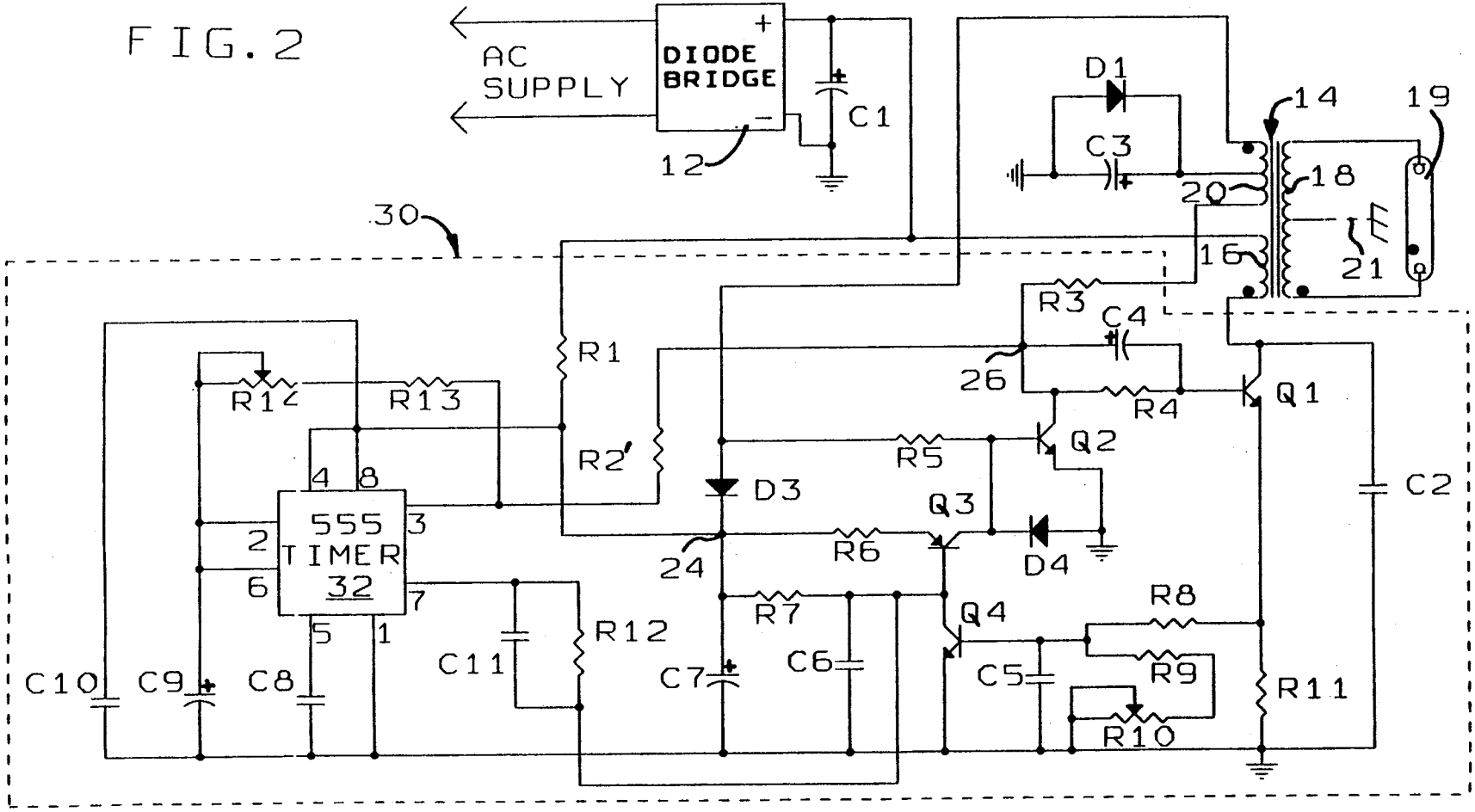
FIG. 2 is a schematic diagram of another embodiment of a power supply according to the present invention which is used to flash a gaseous discharge device.

The power supply in FIG. 1 provides a continuously resonating current through the primary winding 16 to maintain the gaseous discharge device 19 in an excited state. In some instances as it is desirable to produce a flashing illumination from the gaseous discharge device. To do so, the basic control circuit can be modified as shown in FIG. 2.

This circuit 30 incorporates a standard 555 type integrated circuit timer 32 which is configured as an astable multi-vibrator. The positive supply terminal (pin 8) and the reset terminal (pin 4) of the timer 32 receive a positive voltage by connection to node 24 and the control voltage terminal (pin 5) is coupled to ground by a capacitor C8. In this embodiment, diode D2 has been eliminated and resistor R2' is reconnected between the node 26 and the output terminal (pin 3) of the timer 32. The output terminal is also coupled via series connected timing resistors R13 and R14 to the trigger terminal (pin 2). By connecting the timing resistors to the output terminal (pin 3) approximately a fifty percent duty cycle is obtained. The trigger terminal (pin 2) is tied to the threshold terminal (pin 6) and is coupled to ground by capacitor C9. A capacitor C10 is connected between ground and the positive supply terminal (pin 8) of the timer 32 which along with capacitor C8 act as filter which prevent noise from causing erratic timer operation. The discharge terminal (pin 7) of timer 32 is connected by resistor R12 to the base of transistor Q3. A capacitor C11 is connected in parallel with resistor R12.

When power is initially applied to the flasher power supply 30, the output pin 3 of the timer 32 is grounded, thereby preventing the transformer drive transistor Q1 from turning on for approximately half of the normal off period of the timer. This provides a delay before drive transistor Q1 can turn on, which enables capacitors C1 and C7 to charge to levels at which they can supply bias voltage to the components of the control circuit. This delay is similar to the delay provided by Zener diode D2 in the non-flasher version of FIG. 1. As a result, Zener diode D2 is eliminated in the flasher control circuit and resistor R2 is connected directly to node 26.

Eventually, the timer 32 begins astable operation producing a pulsating output having a period between one and six seconds as determined by resistors R13 and R14. When the output at pin 3 goes high, a positive bias voltage is provided to the base of transistor Q1 turning that transistor on and sending current through the primary winding 16 of output transformer 14. While the time output is high the control circuit operates in the same manner as the circuit in FIG. 1.

When the timer output at pin 3 goes low, discharge pin 7 is pulled to ground. This causes the RC network formed by resistor R12 and capacitor C11 to produce a low level pulse at the base of transistor Q3 turning on that transistor for a brief period of time. This in turn causes transistor Q2 to turn on clamping the base of drive transistor Q1 to ground terminating the current flow through the primary winding 16 of output transformer 14. The charge on capacitor C11 holds transistor Q3 and in turn transistor Q2, in conductive states for several resonant cycles of the circuit to insure that the gaseous discharge device 19 turns off.

Eventually when the field in the output transformer collapses completely and a voltage is no longer being induced across secondary 20, transistor Q2 will turn off. However, drive transistor Q1 remains turned off because its base is coupled by resistors R3 and R4 to the continuing low level at output pin 3 of the timer 32. After the off period of the flasher interval, the output of the timer at pin 3 will again go high, turning on drive transistor Q1 and reapplying current through the primary winding 16.

The present topology of the flasher control circuit 30 enables drive transistor Q1 to be turned off in the middle of the resonant cycle without risking failure of the drive transistor Q1.

The invention being claimed is:

1. A power supply for a gas discharge device comprising:

a source of direct current having a first and second output terminals;

a transformer having a primary winding, a first secondary winding across which a high voltage is produced for the gas discharge device, and a second secondary winding;

a reactive element coupled to the primary winding to form a resonant circuit;

a solid state switch having a conduction path and a control electrode which when properly biased renders the conduction path conductive;

means for coupling the primary winding and the conduction path of said solid state switch in series between the first and second output terminals;

a sensor which provides an indication of how much current is flowing through the primary winding; and a bias circuit coupled to the second secondary winding for applying a bias potential to the control electrode of said solid state switch to render the conduction path conductive, said bias circuit also connected to said sensor and removing the bias potential from the control electrode in response to the current flowing through the primary winding exceeding a predefined magnitude.

2. The power supply as recited in claim 1 wherein said bias circuit further responds to the voltage across the primary winding exceeding a predefined level by removing the bias potential from the control electrode.

3. The power supply as recited in claim 1 further comprising a means, coupled to the second secondary winding, for removing the bias potential from the control electrode in response to a predetermined level of voltage being induced in the second secondary winding of said transformer.

4. The power supply as recited in claim 1 wherein said bias circuit includes a timer which periodically causes the bias potential to be removed from the control electrode of said solid state switch to pulse the high voltage produced across the first secondary winding.

5. The power supply as recited in claim 1 wherein said bias circuit further includes a detector for sensing ambient light and adjusting a threshold which defines the predefined magnitude.

6. A power supply for a gas discharge device comprising:

a source of direct current having a first and second output terminals;

a transformer having a primary winding, a first secondary winding across which a high voltage is produced to excite the gas discharge device, and a second secondary winding;

a reactive element coupled to the primary winding to form a resonant circuit;

a solid state switch having a conduction path and a control electrode which when properly biased renders the conduction path conductive;

a first resistor connected in series with the primary winding and the conduction path of said solid state switch across first and second output terminals;

a node;

a second resistor connected between one terminal of said source of direct current and the node;

a storage capacitor coupled between the node and the other terminal of said source of direct current;

a first circuit branch coupling the node to the second secondary winding;

a second circuit branch coupling the node to the control electrode of said solid state switch; and a switch circuit connected to said second circuit branch, said first resistor and the second secondary winding, said switch circuit applying a given potential to the control electrode when voltage across said first resistor exceeds a defined level, and applying the given potential to the control electrode when voltage induced in the second secondary winding exceeds a predetermined level, said solid state switch being rendered non-conductive by such application of the given potential.

7. The power supply as recited in claim 6 wherein said second circuit branch comprises a delay element which prevents said solid state switch from turning on until a given voltage level exists across said storage capacitor.

8. The power supply as recited in claim 5 further comprising a timer coupled to switch circuit, and which periodically causes said switch circuit to apply the given potential to the control electrode.

9. The power supply as recited in claim 8 wherein said timer comprises an astable multi-vibrator.

10. The power supply as recited in claim 8 wherein said timer is coupled to said second circuit branch to periodically interrupt the coupling of the node to the control electrode of said solid state switch.

11. The power supply as recited in claim 6 wherein said reactive element is a capacitor connected in parallel with a series connection of said solid state switch and said first resistor.

12. The power supply as recited in claim 6 wherein said switch circuit comprises:

a voltage divider connected across said first resistor and having a terminal:

a transistor having a collector-emitter path coupling a point of said second circuit branch to circuit ground, and having a base electrode; and means for applying a bias voltage to the base electrode in response to a voltage at the terminal of said voltage divider and in response to the voltage across the second secondary winding.

13. The power supply as recited in claim 6 wherein switch circuit has a means defining for a threshold which said switch circuit employs in determining if the voltage across said first resistor exceeds a defined level; and said means for defining including a detector for sensing ambient light, wherein the threshold is varied in response to the ambient light.

* * * * *